US005655682A

United States Patent [19]

Hoffrichter

[11] Patent Number: 5,655,682

[45] Date of Patent: Aug. 12, 1997

[54] CONTAINER THAT DISPENSES ARTICLES MADE OF THIN AND FLEXIBLE PLASTIC SHEETS

[75] Inventor: Thomas Hoffrichter, Parana, Brazil

[73] Assignee: Phimaplan Industria e Comercio de Materiais Plasticos Ltda, Parana, Brazil

[21] Appl. No.: 497,196

[22] Filed: Jun. 30, 1995

[30] Foreign Application Priority Data

Aug. 26, 1994 [BR] Brazil ..... 94 03005.7

[51] Int. Cl.[6] ..... A47K 10/24

[52] U.S. Cl. ..... 221/45; 206/554

[58] Field of Search ..... 221/33, 45, 47, 221/48; 206/554, 494, 812

[56] References Cited

U.S. PATENT DOCUMENTS 4,046,257 9/1977 Lehmacher ..... 206/554

4,216,863 8/1980 Seymour-Smith ..... 206/554

*Primary Examiner*—Kenneth Noland

*Attorney, Agent, or Firm*—Cushman, Darby & Cushman IP Group of Pillsbury Madison & Sutro LLP

[57] ABSTRACT

A package for dispensing articles formed from individual plastic sheets is disclosed. The package includes a stack of the articles thermally welded together at one edge of the stack, each article having a tear line of longitudinally aligned interrupted cuts formed thereon to facilitate removal of each article from the stack. A plastic wrapping forms an envelope around the stack and a removable mask on the front side of the envelope may be removed to expose an article-removal opening. After the mask is removed, the individual articles may be removed, one at a time, from the package by pulling the article through the article-removal opening and tearing the article from the stack at the tear line. The stack of articles are kept in neat order until dispensed and contaminating exposure of the pre-dispensed articles is minimized. The package includes holes formed therethrough for hanging the package and adhesive patches on the back surface of the envelope to secure the package to a surface.

1 Claim, 3 Drawing Sheets

CONTAINER THAT DISPENSES ARTICLES MADE OF THIN AND FLEXIBLE PLASTIC SHEETS

BACKGROUND OF THE INVENTION

1. Field of the Invention

The object of this patent for the invention described below, whose main characteristics are claimed and represented by the attached illustrations (sheets 1 to 3, FIGS. 1 to 6), is a container package that dispenses articles made of thin and flexible plastic sheets like bags, gloves, sheets for wrapping and others, previously attached to one another by thermal welding.

One of the fundamental characteristics of the invention lies in the fact that the container package is attached, also by thermal welding, to the wad of articles placed within it, forming a single, cohesive unit, linked by the above-mentioned process along the upper edge of the unit thus formed.

2. Description of the Problem Addressed by Invention

Wads of plastic sheets, gloves and other articles are usually found in stores, chemists, supermarkets and others either for use by the public or for sale to consumers. These wads are generally held by hooks, and are totally exposed to external contact, without any appropriate wrapping able to ensure the product's cleanliness while it is exposed to manipulation by the public.

Thus the waste of this type of material is quite common in supermarkets, where wads of plastic bags are available to the users, as they usually detach more than the units they will really require from the wads.

Another inconvenience concerns the current system used in supermarkets: the difficulty of finding the opening of the plastic bag and of separating the sides once the bag has been removed from the wad. Because of the way they are manufactured the front and the back of these bags are closely juxtaposed and require a lot of effort both to identify and to separate the edges of the opening of the bags with the tips of the users' fingers.

SUMMARY OF THE INVENTION

This invention would overcome such inconveniences, both as regards the product's cleanliness and exposure to the public and also in terms of sales point savings (for supermarkets and others) since, thanks to the special arrangement of the device object of the innovation, users will only detach one unit at a time by manual removal, while the remainder will continue attached to the wads inside the container, protected on all sides from any external contact.

Still in regard to the plastic bags, the invention, due to its characteristics, will facilitate their handling by the users, as the container allows the bags, when detached from the container, to open up ready for use, and users no longer have to pull the edges apart to open them.

Similarly, the invention is especially applicable to hold all and any articles made of thin and flexible plastic sheets for personal, domestic or even commercial use like, for example, the above-mentioned gloves, thin sheets for wrapping and others, sold in places where there is great popular demand.

The attached drawings represent illustrations of the invention. This is based on the traditional system where the plastic units—"U"—(bags, gloves, and others) are previously grouped in wads, or a stack, —"B"—forming a unit having, on the upper edge, a single, solid, thermally welded strip—

"T"—, with openings—"F"—to be hung from fixation hooks—"G"—, and where, below and in parallel to this strip, the above-mentioned units have a weaker—"L"—tear line, with longitudinal cuts—"C"—for the manual removal of the articles characterized, however, a) by the fact that the wads "B" thus formed are totally covered by a plastic wrapping "1", like an envelope, with a thin, flexible sheet, thermally welded along the upper edge "2", both in front and behind the above-mentioned strip "T", above the previously weakened line "L"; b) by the fact that the said container "1" has, on the front "3", a removable mask "4" with varying dimensions and formats, with a perforated contour "5". This contour may partially cover or not the above-mentioned strip "T" and/or at least one segment of the above-mentioned line "L"; c) by the fact that the container "1" has two openings "6" on its upper edge "2" that coincide with the above-mentioned openings "F" foreseen in the above-mentioned single strip "T"; d) finally, by the fact that the said container "1" is placed on its back "7" with one or more glued applications or adhesive pads, "8" on its external surface "9". This surface is covered by a protective cover "10", glued to the upper edge "2", jointly with container "1", forming the single strip "T", that can be removed, and the glued applications "8".

DETAILED DESCRIPTION OF THE PREFERRED EMBODIMENTS

Figure 1:
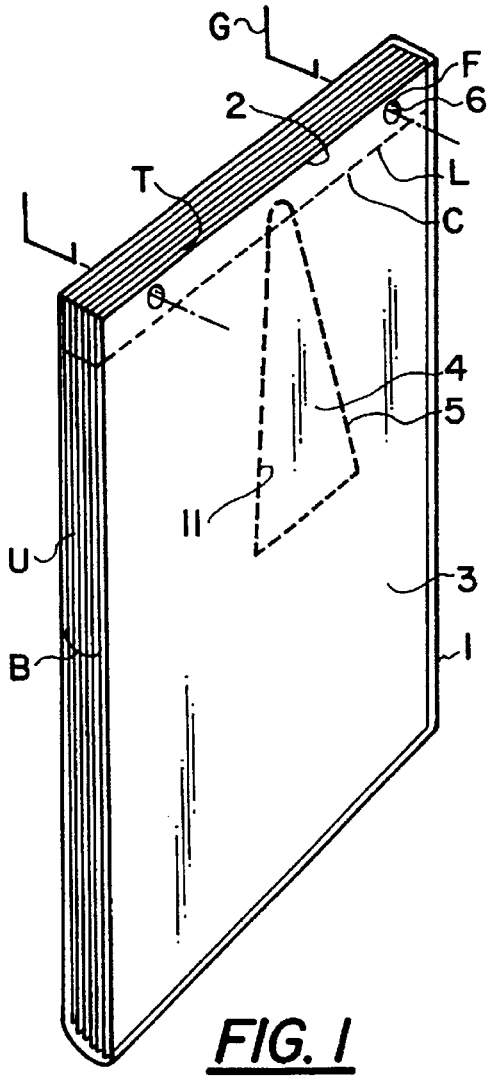
FIG. 1 is a perspective view showing a front side of the present invention.
Figure 2:
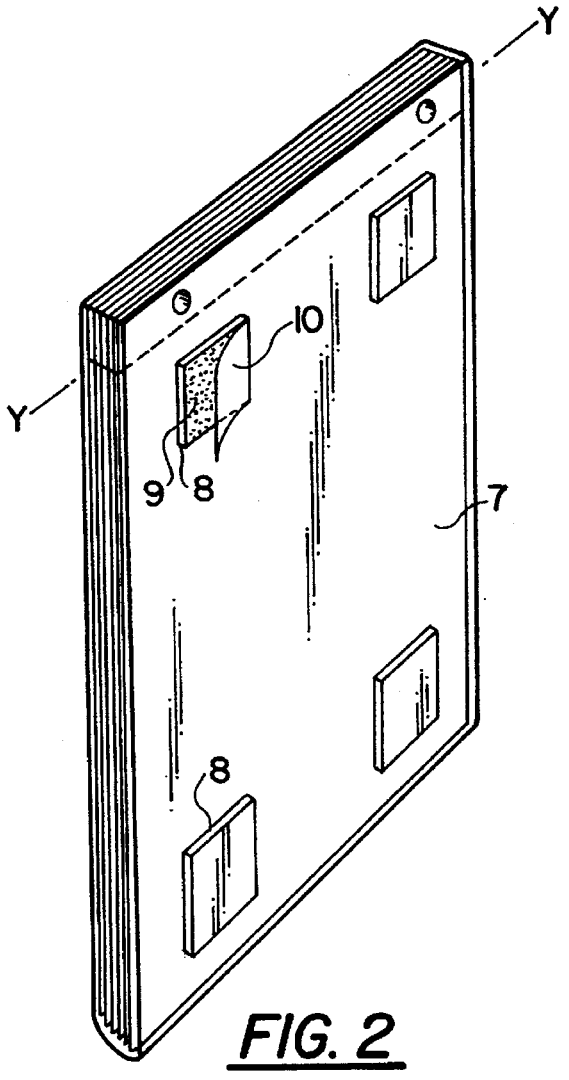
FIG. 2 is a perspective view showing a back side of the present invention.
Figure 3:
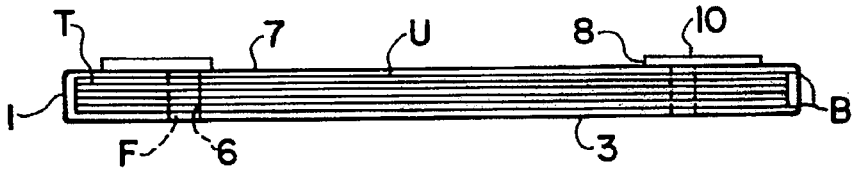
FIG. 3 is a cross-sectional top end view of the present invention along the line Y—Y in FIG. 2.
Figure 5:
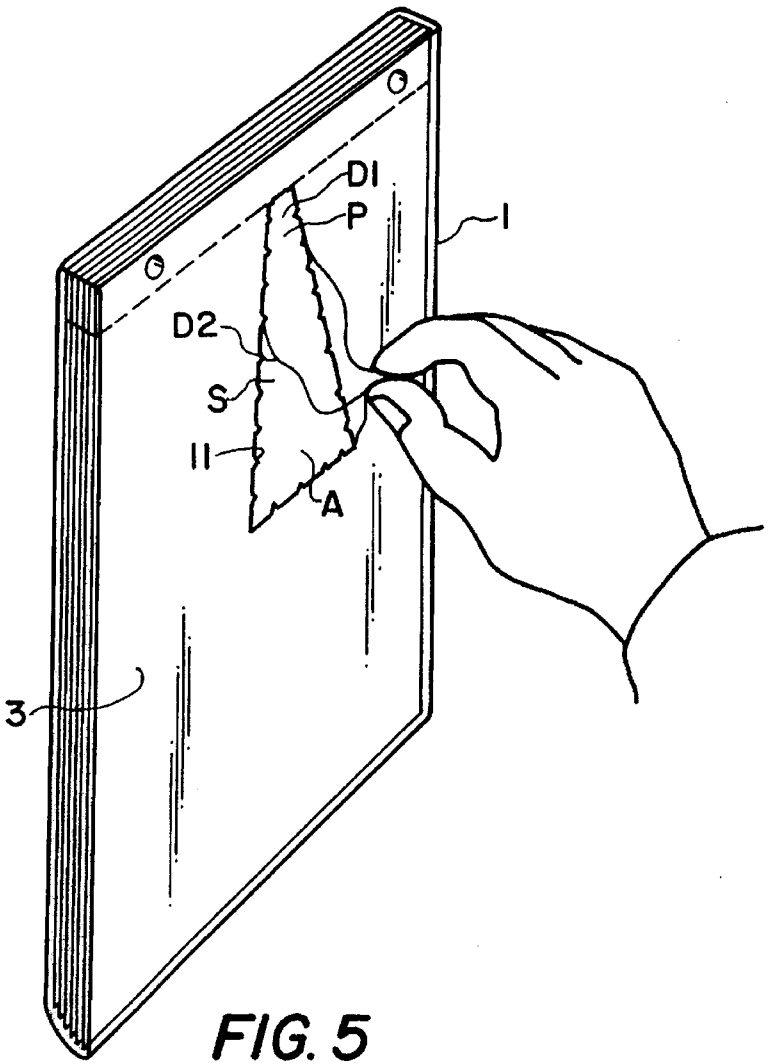
FIGS. 4 and 5 are perspective views showing typical use of the present invention.
Figure 4:
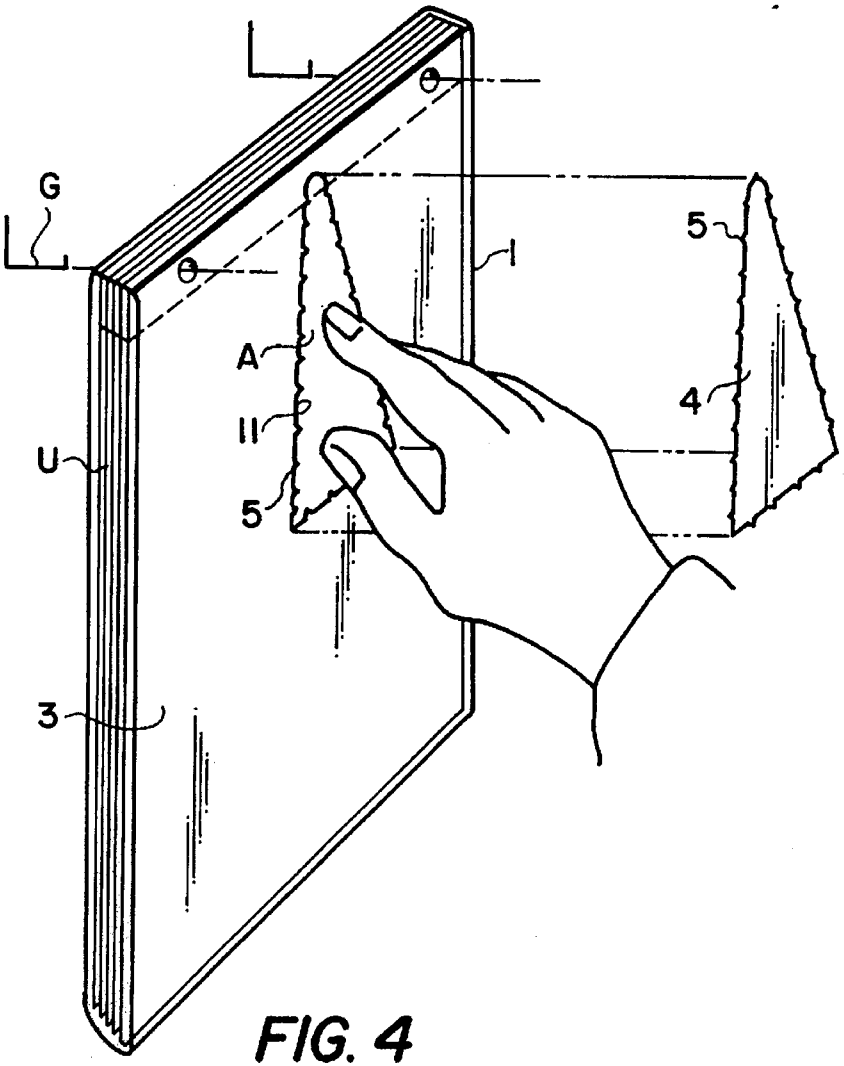
Figure 6:
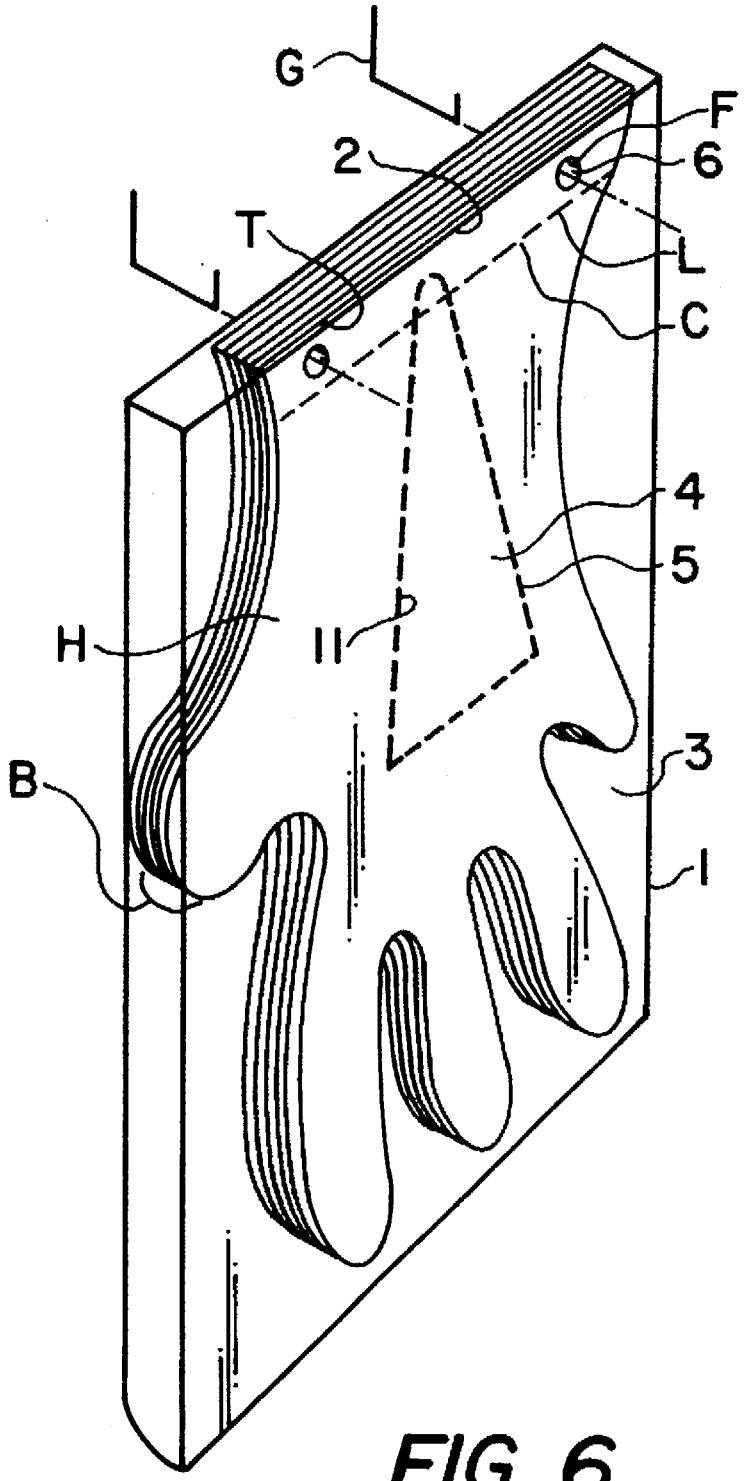
FIG. 6 is a perspective view of the present invention showing details of the contents of the container.

As described, the container thus foreseen holds the wads "B" of plastic units "U", and constitutes, together with it, a single unit, thermally welded with reciprocal cohesion, effected along the length of the unitary strip "T" and hung by its coinciding openings "F" and "6" on conventional hooks "G" and glued, on the back "7", to an appropriate smooth surface, through glued applications "8", once their protective cover "10" has been removed. On the other hand, manual access to the articles stored inside container "1" is obtained through opening "11" determined by the prior removal of mask "4" by loosening its perforated contour "5".

In the drawings, FIGS. "1" and "2" are seen in perspective, from and back, respectively, of the unit thus formed, with all the characteristic details described above. In these figures, for purposes of clarity, the wad is represented by full lines, although it should be understood that it is inside container "1", also represented by full, but thicker, lines. FIG. "3" is an additional schematic, seen from above, of the set object of the invention, with a cross-section "Y—Y" of FIG. "2". FIGS. "4" and "5" substantially repeat the representation of FIG. "1" showing, in two successive instances, the manual act of detaching and pulling the plastic unit from the inside of container "1". This is done simply, practically and hygienically.

Thus, once mask "4" has been removed and once the access "11" to stored articles "B" has been opened, it is enough to apply on the plastic unit U immediately exposed a slight digital pressure (FIG. "4") to find a point of support and pull it downwards and outwards in a continuous, smooth effort.

As we can see, the amount of articles thus removed is strictly limited to a single one, and the subsequent one will be attached to the wads of articles, waiting for a new movement of manual removal, identical to the former. It is a simple, practical and clean operation, as the remaining articles are perfectly protected inside the container, with a minimal external contact, restricted only to opening "11" that is only large enough to allow the removal of one item at a time.

In the special case of plastic bags "S" the bag, when being removed from the container as shown in FIG. "5", opens automatically during the movement because, according to the invention, only the front part "A" of the bag is initially subject to manual pressure, and is the first to become detached from the cut line "L" of the bag "B", beginning to become detached through opening "11". Only after this do we see, due to the continuation of the pressure mentioned above, the detachment of the back part "P" of the bag, that results from this movement of extraction, which occurred practically in two successive phases, the automatic opening of edges "D1" and "D2" of the opening of the bag.

FIG. "6", finally, repeats the basic representation of FIG. "1", illustrating, through examples, the removal of the units placed within the container (if these are gloves "H"), equally glued along the upper edge "2" jointly with container "1", forming the unitary strip "T", thermally welded.

As can be observed from the description above, the object of this patent for the invention described below is a single and cohesive trait, and can be used both in commercial areas, in supermarkets, stores, chemists and others, as well as in private homes, for domestic and office use, and others, wherever the presence of plastic articles like the above examples is required (bags, gloves, sheets for wrapping, etc.).

I claim:

1. The package for dispensing articles formed from plastic sheets, said package comprising:

a stack of thin and flexible plastic sheets having formed on an upper edge thereof a thermally welded strip holding each of said sheets of said stack together, at least one opening extending through said stack adjacent said strip for hanging said package thereon, each of said sheets having a tear line of longitudinally aligned interrupted cuts extending across said sheet below and parallel to said thermally welded strip, said tear line permitting each of said sheets to be individually torn from said stack at said tear line;

a plastic wrapping forming an envelope over said stack and thermally welded along an upper edge thereof to said stack along opposite sides of said thermally welded strip above said tear line, said envelope having at least one opening formed therein corresponding to said at least one opening extending through said stack for hanging said package thereon;

a removable mask formed on a front side of said envelope and defined by a perforated contour extending around said removable mask; and at least one adhesive pad disposed on a back side of said envelope and covered by an associated protective cover for adhering said back side of said envelope to a surface after removal of said protective cover.

* * * * *